United States Patent [19]

Patz et al.

[11] Patent Number: 4,819,560

[45] Date of Patent: Apr. 11, 1989

[54] DETONATOR FIRING ELEMENT

[75] Inventors: Vivian E. Patz, Yeoville; Stafford A. Smithies, Pretoria, both of South Africa

[73] Assignee: Detonix Close Corporation, South Africa

[21] Appl. No.: 53,150

[22] Filed: May 21, 1987

[30] Foreign Application Priority Data

May 22, 1986 [ZA] South Africa ..... 86/3818
Dec. 8, 1986 [ZA] South Africa ..... 86/9263

[51] Int. Cl.[4] ..... F42C 19/12

[52] U.S. Cl. ..... 102/202.5; 102/200; 102/202.14

[58] Field of Search ..... 102/202.5, 202.14, 206, 102/217, 218, 200, 322

[56] References Cited

U.S. PATENT DOCUMENTS 3,659,527 5/1972 Abegg et al. ..... 102/202.7
4,393,779 7/1983 Brede et al. ..... 102/202.5
4,484,523 11/1984 Smith et al. ..... 102/202.5
4,489,655 12/1984 Molnar ..... 102/217
4,708,060 11/1987 Bickes, Jr. et al. ..... 102/202.5

FOREIGN PATENT DOCUMENTS 2123122 1/1984 United Kingdom ..... 102/202.5
2164730A 3/1986 United Kingdom .

*Primary Examiner*—Charles T. Jordan
*Attorney, Agent, or Firm*—Pasquale A. Razzano

[57] ABSTRACT

A detonator firing element which includes a miniature energy dissipation device located on a substrate which forms part of an integrated electronic circuit. An explosive or pyrotechnic compound is exposed to the effects of energy dissipated by the device. The device may be resistive, be formed by a semi-conductor device, or be a field effect device. The integrated circuit includes timing, testing, control, communication and interlock circuits to implement stand alone or computer controlled blast systems. Protection against over-voltages and induced currents is provided. Due to the integrated circuit approach power consumption is kept to a minimum and a detonator incorporating the firing element can be powered for a substantial time period by an energy storage device such as a capacitor.

16 Claims, 8 Drawing Sheets

DETONATOR FIRING ELEMENT

BACKGROUND OF THE INVENTION

This invention relates to the initiation of explosives and more particularly to a detonator firing element which, incorporated in a detonator, is suitable for use in a sequential blasting system.

In a sequential blasting system it is essential to be able to control accurately and safely the firing of each individual explosive. Attempts have been made to meet this objective by means of various forms of detonators. To the applicant's knowledge such detonators, although satisfactory in many respects, do not meet all of the following criteria: low assembly cost, low energy storage needs prior to and during detonation, stringent safety standards, accurate signaling and timing periods, and reliable fail-safe and intrinsically safe operation.

SUMMARY OF THE INVENTION

The invention provides a detonator firing element which includes at least one energy dissipation device which is located on or in a suitable substrate for the fabrication of an integrated circuit.

The energy dissipation device may be resistive, be formed by a semi-conductor device or be a field effect device.

In the first instance the energy dissipation device may be formed by a resistive layer which is deposited on the substrate. A current which is passed through the resistive layer causes heating thereof. By way of example the resistive layer may be formed from at least one of the following, referred to hereinafter as "the preferred materials": nichrome, gold, tungsten, aluminium, zirconium, polysilicon, a titanium/tungsten mixture, and metal silicides.

A resistive element may also be formed for example by means of a diffusion or implanting technique. For instance in the former case a layer of P-type silicon may be diffused into a predominantly N-type silicon substrate to provide the resistive element. The P-type and N-type silicon layers may be interchanged. In the latter case ion-implanting techniques may be adopted to form the resistive element.

The resistive element may be designed so that it releases heat when an electrical current is passed through it. In a variation of this approach the resistive element is designed so that it forms a fusible link which is fused when a current of a predetermined amplitude passes through it. The fusing of the link then releases a predetermined quantity of energy. The release of energy is used to initiate a primary explosive charge. A plurality of links may be used on the same substrate to improve the probability of initiation.

When use is made of deposition techniques to form the resistive element, the element may be deposited in a thin layer on the substrate with the thickness of the layer for example between 10 and 1000 nanometers. A mask may be used to define a desired pattern of the resistive element, and contact areas, and excess material may be etched away or removed in any suitable manner. The resistive element which is formed in this way has a very low thermal mass and may be heated by the discharge of a minimum quantity of electrical energy.

The energy dissipation device, as has been pointed out, may alternatively comprise a semi-conductor element. Suitable elements are transistors, field effect transistors or related devices, four-layer devices, zener diodes, light emitting diodes, or any other suitable element which emits heat or light energy upon activation which preferably takes place by passing an electrical current through the element. The energy may be dissipated in a narrow region between active N- and P-regions. This makes it possible accurately to concentrate the released energy.

According to a third variation of the invention the energy dissipation device may be a field effect element. The field effect element may be formed by first and second spaced electrodes on the substrate, and switch means for applying an electrical potential across the electrodes. In this way a high intensity electrical field is created between the electrodes.

The electrodes may be metallic, or formed from any one of the preferred materials.

The electrodes may essentially be two-dimensional in the sense that they are formed by conductive bodies in flat layers on the substrate; alternatively they may be three-dimensional in the sense that they have material sizes in three orthogonal dimensions.

The electrodes may be of any suitable shape. The electrodes may for example consist of spaced plates which are parallel to one another. The electrodes may otherwise be curved, triangular or shaped in any way. In one form of the invention the electrodes are formed by a comb or interdigitated structure.

In one form of the invention the electrodes comprise first and second conductive bodies, the first body being formed with an open central portion which is occupied by the second body. The bodies define an annular gap between them across which the potential difference is generated.

The electrodes may be formed in any suitable way and preferably are formed by depositing one of the preferred materials on a dielectric passivation layer of the substrate. The material may be etched to a desired shape.

The switch means may include first and second switching devices with the first device being connected between the first and second electrodes and the second device being connected to the second electrode and to one pole of an electrical supply, and the first electrode being connected to the other pole of the electrical supply. In standby operation, i.e. when an explosion is not to be initiated, the first switching device is on and the second switching device is off. The detonator firing element is then made operational by turning the first switching device off and the second switching device on. In this way the electrical potential is applied across the electrodes.

An explosive may be located adjacent, or in direct contact with, the energy dissipation device which, upon being actuated, initiates the explosive by the dissipation of energy.

As has been pointed out the dissipation of energy, in most examples of the invention, causes the release of heat and this heat is used to initiate the explosive. However it is possible to have the energy dissipated in the form of light in which event the light initiates the explosive.

In the third variation of the invention, i.e. that based on the use of a field effect device, the explosive is actuated by an electrostatic discharge or a high electrical field.

Suitable explosives are primary explosives such as silver azide, lead or barium styphnate, mercury fulminate and any suitable secondary explosives such as RDX and HMX, a mixture of any of the foregoing, or any other appropriate material solid, liquid or gaseous with the desired characteristics. The explosive material may itself be made conductive by the addition of small amounts of a conductive material such as graphite or an organic semi-conductor. In this way the explosive material may be directly heated due to current flow which is induced in it. In the case of the field effect device the explosive may include a component such an organic semi-conductor suspending an oxidising agent which reacts chemically in the presence of the electric field in an exothermic reaction. More generally the explosive material in the field effect device may include a field sensitizer.

The substrate may form part of a solid state electronic device which includes integrated circuitry for controlling the actuation of the detonator firing element. The detonator firing element may be placed on a surface of a passivation layer covering the electronic device with suitable openings being provided to enable electrical contact to be made with the device. Alternatively it may be placed below the passivation layer, with or without an opening or openings through the passivation layer. It is to be noted that a cover over the detonator firing element reduces its sensitivity.

The explosive is located adjacent the energy dissipation device. Preferably the explosive adheres at least to a surface of the substrate so that it is in intimate physical contact with the substrate. Liquid or gaseous explosives, particularly, may for example be located together with the energy dissipation device in a sealed container. In this way efficient energy transfer takes place between the energy dissipation device and the explosive.

The quality of the physical contact of the explosive on the substrate may be improved through use of an adhesion promoter. This improves the bond between the explosive and the substrate surface. The explosive may be deposited in solution or liquid suspension. The adhesion promoter may be formed by a wetting agent. A binder such as PVC or nitrocellulose lacquer may be added to the solution or suspension. Mechanical strength is simultaneously added to the assembly, in the case of a solid explosive.

The assembly of the explosive and the detonator firing element may be coated by means of a suitable protective inert sealant such as silicone rubber which adheres to the substrate and, which as it cures, draws the explosive and substrate together.

In one form of the invention a window is provided in the substrate with the energy dissipation device located therein. The explosive is then located in the window in contact with the energy dissipation device. It is pointed out however that the window is not essential and that in certain instances it suffices if the explosive is located in close proximity to the energy dissipation device.

The explosive may alternatively be liquid, or gaseous, and be sealed in a container together with the energy dissipation device. This avoids explosive deposition problems.

The control circuitry included in the solid state electronic device may comprise predefined logic building blocks to provide customised explosive control systems at low design cost. Such building blocks may for example include oscillators, counters and timers, phase locked loops for accurate clock extraction, communication circuits, interlocking control circuits, self-test circuits and electromagnetic interference suppression circuits.

The combination of a miniaturised detonator firing element of the kind described with an integrated electronic circuit results in complex signal processing becoming available at low cost and with a high reliability factor.

Over-voltage protection means may be included to protect the energy dissipation device against inadvertent initiation. Traditionally detonator firing elements have not been made small since a reduction in size leads to an increase in sensitivity to stray voltages or currents. However by adopting an integrated circuit approach and by including an overvoltage protection a high degree of immunity against electromagnetic interference is achieved. The protection arrangement may additionally include switching means, connected to the energy dissipation device, to provide protection against induced electrical currents.

A detonator firing element of the kind described may be provided mounted in a housing, with explosive material in the housing arranged to be initiated by the initiating explosive referred to, thereby to form a detonator.

Means may be provided for applying electrical energy to the energy dissipation device and circuitry. This means may include a capacitor which is under the control of a timing circuit or any other electrical storage device.

The invention also extends to a sequential blasting system which includes a plurality of detonators of the kind described connected in series, and means for controlling the firing of individual detonators.

The control means may be adapted to programme a selected delay interval into a timing circuit associated with each respective detonator.

Over-voltage protection devices may be located between selected pairs of detonators. This further increases the immunity of the system to induced voltages or currents.

BRIEF DESCRIPTION OF THE DRAWINGS

The invention is further described by way of examples with reference to the accompanying drawings in which.

DESCRIPTION OF PREFERRED EMBODIMENTS

Figure 1:
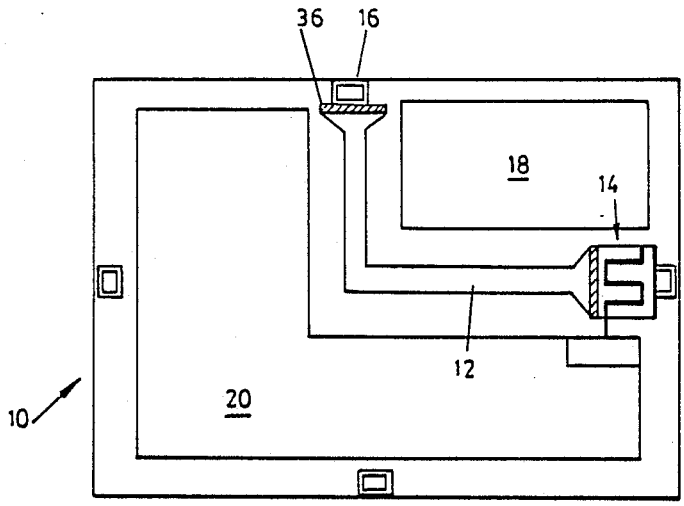
FIG. 1 is a plan view of an integrated electronic detonator including a resistive detonator firing element according to one form of the invention.

FIG. 1 illustrates, from above, an integrated electronic detonator 10 which includes a detonator firing element 12, a transistor 14, bonding pads 16, over-voltage protection circuitry 18, and timing and communication circuits 20.

The detonator firing element 12 is in effect a miniature fuse with an extremely low thermal mass and it is formed by depositing a thin layer of resistive material, or any of the preferred materials, on top of a passive layer of an integrated circuit. The thickness of the resistive layer is of the order of 10 to 1000 nanometers. A mask is used, in a conventional way, to define the pattern of the detonator firing element, and the contact areas which are to remain, and excess material is then etched away.

Figure 2:
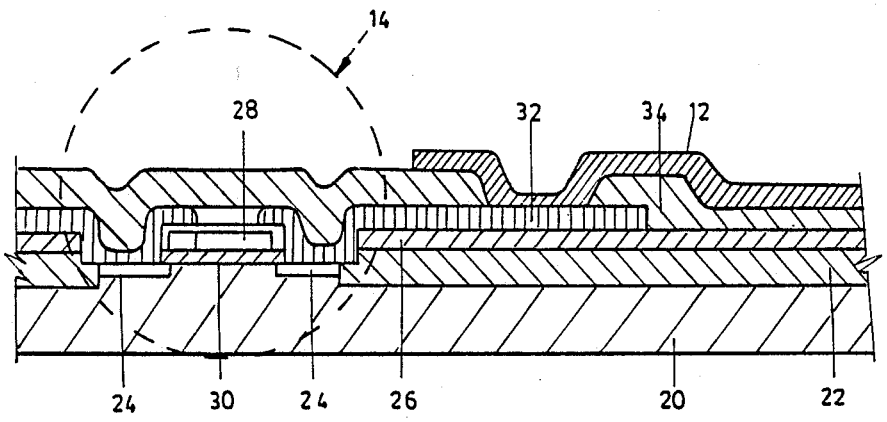
FIG. 2 is a cross sectional view of the circuit of FIG. 1.

The integrated circuit on which the detonator firing element is fabricated is shown in cross-section in FIG. 2. In this example the circuit is of the CMOS type and its construction is substantially conventional and therefore is not elaborated on. Referring to FIG. 2 the following components may be identified:

A silicon substrate, N-type: reference 20,
Grown field oxide: reference 22,
P diffusion regions: reference 24,
Deposited oxide: reference 26,
Poly-silicon gate: reference 28,
Thin gate oxide: reference 30,
Aluminium interconnect layer: reference 32,
Passivation or scratch protection layer: reference 34,
Detonator firing element: reference 12.

The transistor 14, shown in FIG. 1, is of the field effect type and is defined by the regions 24, the gate 28 and the gate oxide 30.

The aluminium interconnect layer 32 is connectable to the bonding pads 16, see FIG. 1, through contact openings in the passivation layer 34.

Figure 3:
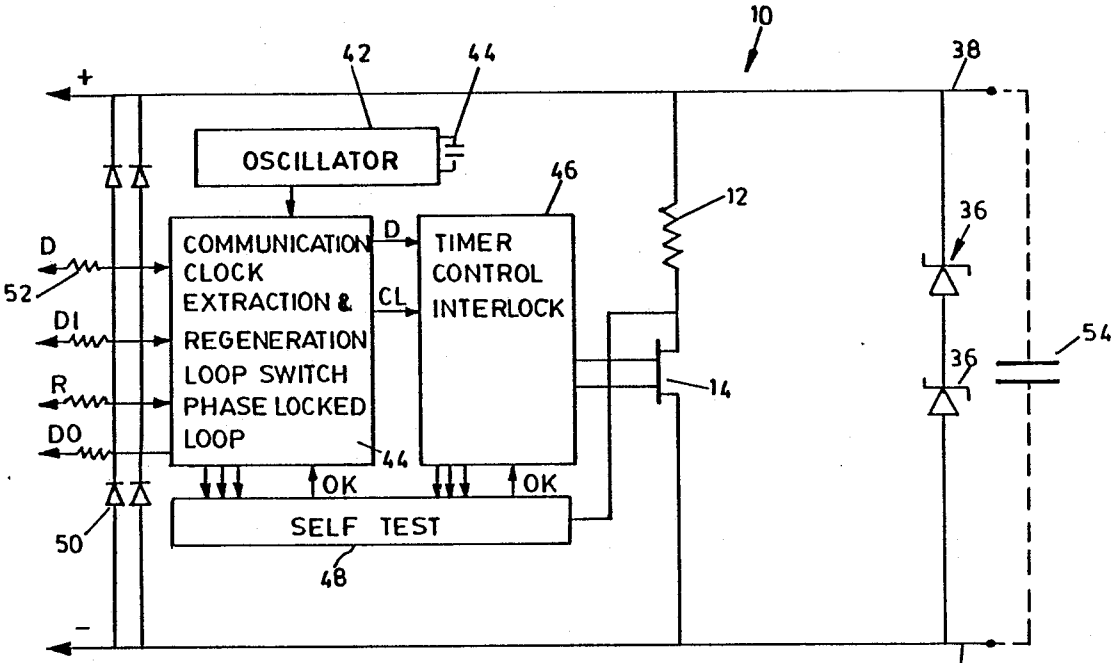
FIG. 3 illustrates one embodiment of a circuit which may be incorporated in each detonator.

FIG. 3 illustrates, substantially in block diagram form, the detail of the integrated circuit which incorporates the detonator firing element. In FIG. 3 the detonator firing element 12 is illustrated as a resistor in series with the field effect transistor 14. Two 6 volt zener diodes 36, fabricated in series across the components 12 and 14, are connected to power supply links 38 and 40. These diodes are intended to prevent stray energy from triggering the detonator and are located below the deposited oxide layer 26. This layer is thermally insulating.

The circuit of FIG. 3 includes an oscillator 42 with a timing capacitor 44 which is buried below the detonator firing element, a communication circuit 44 which incorporates a phase locked loop which synchronizes the clock which is on the chip, and which is unstable, to an accurate data clock to ensure precise timing of the circuit, and a timing and interlock circuit 46. The circuit is clocked by the phase locked loop reference clock.

The circuit further includes a self-test module 48 which checks all circuit functions on power-up. Diodes 50 and resistors 52 on lines D (data in clock), DI (data in), R (reply), and DO (data out), provide static protection for the CMOS circuit.

The field effect transistor 14 is designed to control discharge of electrical energy from a storage capacitor 54 through the detonator firing element 12. The storage capacitor is relatively large and does not form part of the integrated circuit but rather is a discrete component.

Figure 4:
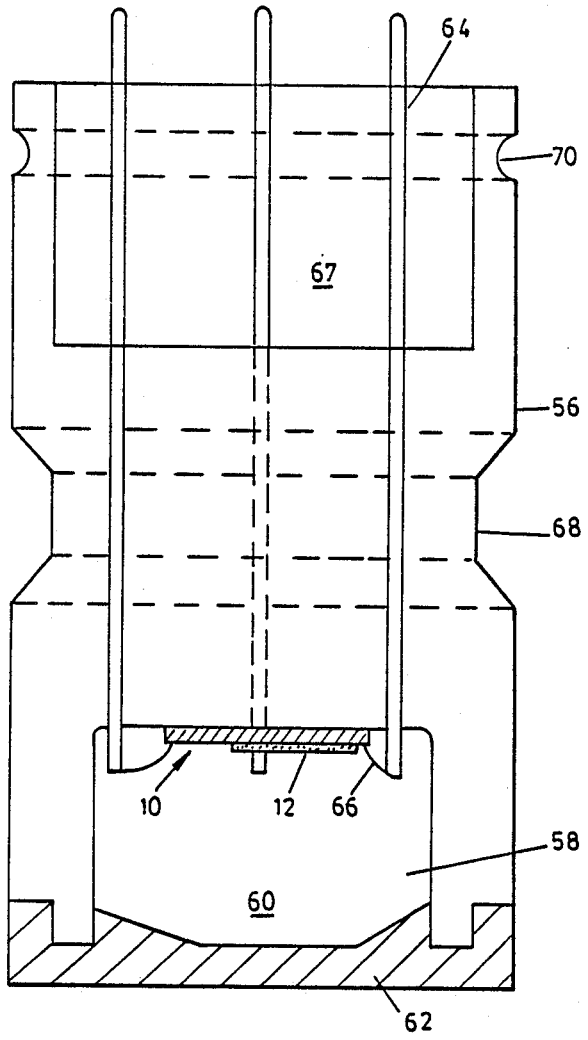
FIG. 4 is a side view, partly cross sectioned, illustrating the physical assembly of a detonator firing element.

FIG. 4 shows the component 10 mounted in a casing 56 which is moulded from a suitable plastics material and includes a cavity 58 in which the component 10 is installed. The remainder of the cavity is occupied by an explosive 60. The cavity is sealed by means of a shaped lid 62 made from a plastics material. Plug pins 64 extend through the casing 56 and are connected to the component 10 by means of leads 66. The component 10 is positioned so that the detonator firing element 12 faces into the cavity 58 and is in contact with the explosive 60.

The casing 56 includes a second cavity 67 which is occupied by the storage capacitor 54 illustrated in FIG. 3. The casing is formed with a first groove 68 at a midpoint and a second groove 70 which extends around the cavity 67.

Figure 5:
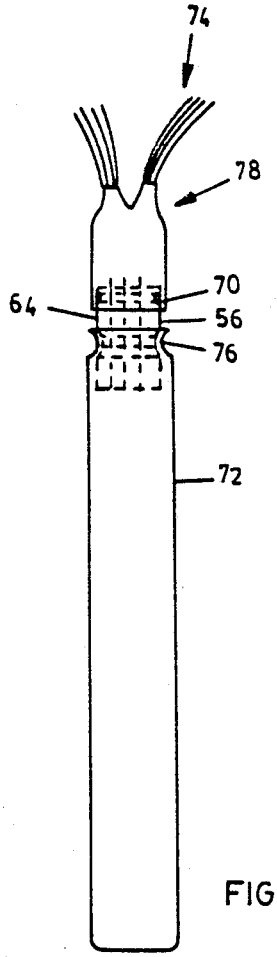
FIG. 5 shows a detonator constructed in accordance with the invention.

FIG. 5 shows the casing 56 connected to a detonator can 72 so as to form a complete detonator 74. The detonator can is filled with a suitable explosive and is fixed to the casing 56 by being crimped at a location 76 into the groove 68. The casing 56 is orientated so that the cavity 58, with its explosive, extends into the detonator can.

A wiring harness 78 which makes electrical contact with the pins 64 is attached to the upper end of the casing 56 and is secured to the casing by engagement with the upper groove 70.

Figure 6:
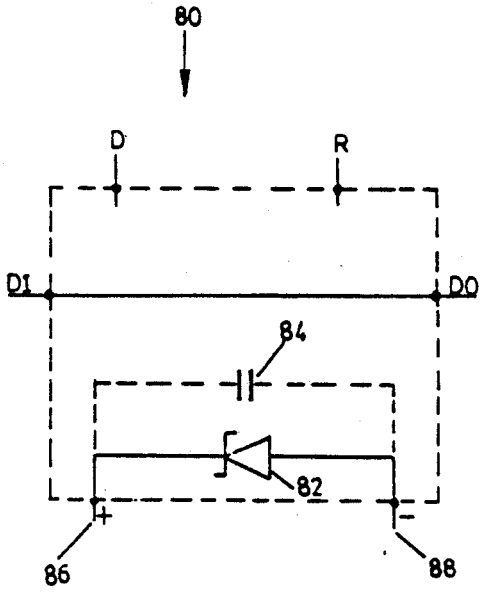
FIG. 6 illustrates a protection device used in a sequential blasting system according to the invention.

FIG. 6 illustrates a protection device 80 which is used in conjunction with a plurality of the detonators 74 shown in FIG. 5. The protection device includes a fast voltage breakdown diode 82 which is shunted by a capacitor 84 which provides a low impedance path for high frequency noise.

The device 80 includes identical connections to those shown in FIG. 3 for the component 10. Thus it includes two power line connections 86 and 88 respectively which correspond to the connections 38 and 40 on the device 10 and D, R, DI and DO terminals which correspond to similarly marked terminals in the diagram of FIG. 3. It is to be noted that the terminals DI and DO are directly connected and thus provide a link which is transparent to signals transmitted down the data line. The D and the R terminals are not used in any way.

Figure 7:
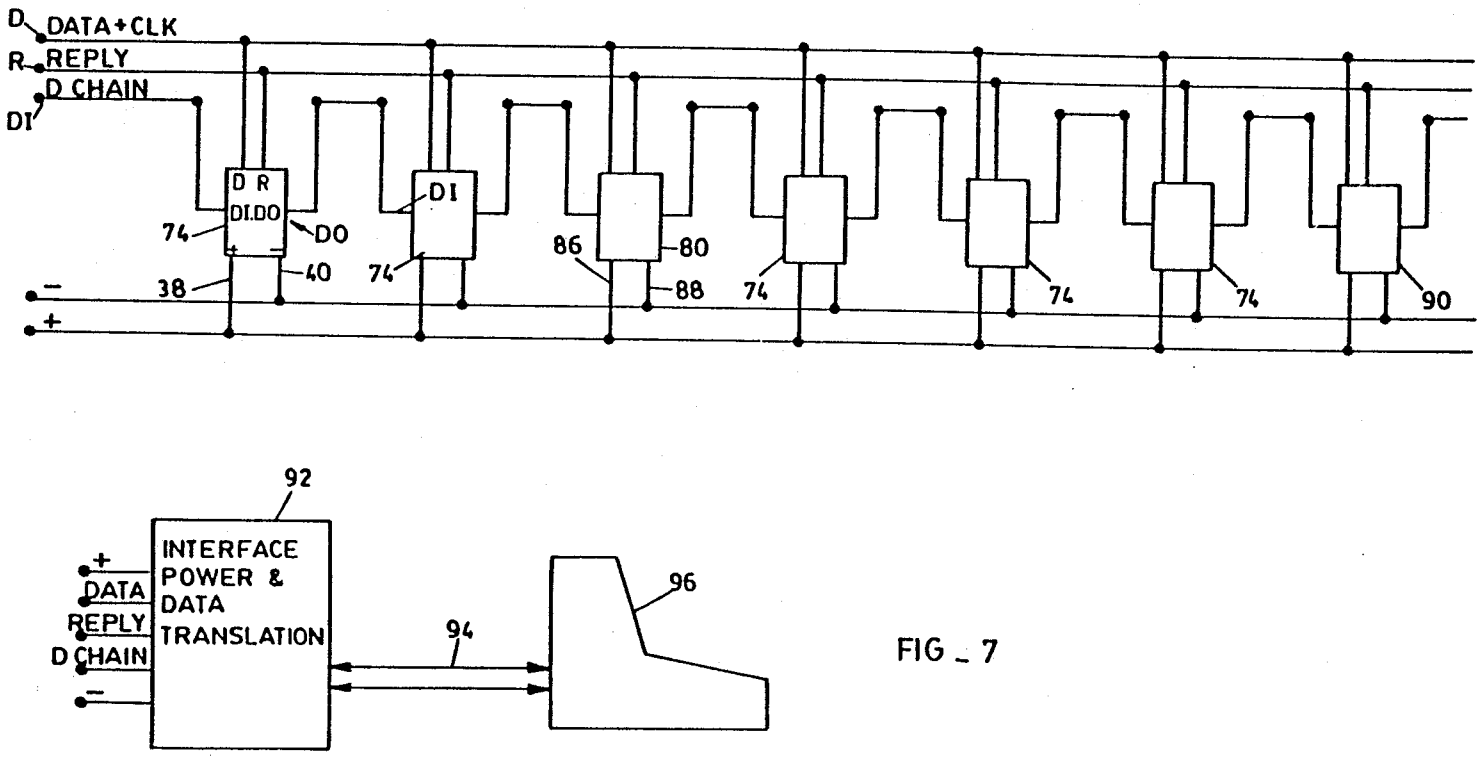
FIG. 7 illustrates a sequential blasting system according to the invention.

FIG. 7 illustrates a sequential blasting system which includes a plurality of detonators 74 with protection devices 80 connected between adjacent pairs of the detonators at selected locations. The sequence of detonators is terminated by means of a device 90. The DO and DI terminals of adjacent devices are interconnected to provide a daisy chain link down the system.

The detonators are installed physically at desired locations in accordance with conventional mining techniques. In noisy electrical environments the number of protection devices 80 is increased to enhance the noise immunity of the system.

The sequential blasting system includes an electrical interface 92 which feeds power to the detonators and which translates signalling protocols between a conventional communications link 94, from a control computer 96, and the detonator signals.

It is desirable to test a sequential blasting installation at low voltages using field test units before the blasting sequence is actually initiated. Ideally the test should take place under energy supply conditions where the supply voltage is below 3 volts which ensures that, in the event of a malfunction, none of the detonating firing elements can be heated sufficiently to cause detonation. The testing sequence is designed to indicate faulty units by number prior to their connection into the blasting system.

The computer is used to generate delays for controlling the desired blasting sequence. The manner in which the delay signals are generated is not important for an understanding of the present invention and so is not described in this specification.

All the detonators 74 in the system shown in FIG. 7 are identical and no user address programming is desirable. To allow the individual detonators to be addressed however a handshake signal is included in the communication scheme. This allows each device to alert its neighbour once it has finished communicating. Thus the computer asserts a handshake, the first device gets addressed and replies and then its asserts its handshake to the next device. The computer communicates with all the devices in the line in turn until the second last device asserts its handshake to the terminating unit 90. This unit then signals to the computer that it has reached the end of the string whereafter the computer sends out a signal which resets all of the handshaked lines ready in the system for another communication cycle. In this way each unit can be assigned a number by the computer for fault finding and general communications.

To prevent spurious firing several communication cycles can be used with an interlock mechanism. For example the sequence could be as follows: the system is initially powered up and the computer then addresses each device and obtains the results of the self test process carried out by means of the onboard circuitry on each detonator, and the number of detonators. The computer then writes a delay time to each detonator, and each detonator retransmits the delay to the computer for verification. The detonators are then armed by means of a statistically unique signal i.e. a signal which has a low correlation with random noise in the particular environment. Thereafter a "go sequence" is initiated, again by means of a statistically unique signal, and this causes detonation.

The proposed safety interlock sequence allows current to pass through to each detonator firing element only if the self test carried out by the particular detonator is satisfactory, the devices have a delay correctly programmed, a valid arm sequence has been received, a valid go signal has been received, and the delay period has expired.

In one tested example of the invention a 4.7 $\mu$f capacitor discharged 14.7 v into a detonator firing element which included a sputtered link with dimensions of 80 $\mu$m by 8 $\mu$m. The link was covered with lead styphnate. The reaction time measured from application of current to the sighting of a light flash from the exploding lead styphnate was 30 $\mu$s. The energy applied was therefore slightly less than 20.9 $\mu$Joule.

The energy for heating the detonator firing element is stored in the capacitor 54. This capacitor has a capacitance of 10 $\mu$F and is charged to 11 volts which provides adequate energy for powering the circuit and heating the detonating firing element. Thus each detonator is powered by means of onboard power and once the delay period has expired will explode on time even if the leads which connect it to the main power supply have been damaged. As no heavy firing current passes down the system low quality connectors may be used to interconnect the devices in the sequential blasting system.

The time for which each device can operate, once disconnected from the power supply, is limited by the size of the capacitor. A substantial number of detonators may be incorporated in a sequential blasting system with long delays between detonations implying long explosion times. By blasting the detonator which is furthest from the power supply first the total energy storage requirement for each device is substantially reduced. Since power is fed in a direction which is opposite to the direction of propagation of the explosion, flying rock can isolate the power locally. Thus it is preferred to fire the detonators in the reverse sequence to obtain the benefit of reduced energy storage requirements.

The invention provides detonators which enable a fully integrated low cost and reliable detonation system to be implemented. Sequential delays in the system are accurately defined and complex blast patterns are relatively easy to programme.

The basis of the invention resides in the incorporation of the detonator firing element into an electronic chip. The chip moreover includes suitable circuitry for carrying out onboard test timing and protection functions.

Two overvoltage protection stages are included, namely that provided by the protection devices 80, and by the on-chip protection systems. The on-chip protection voltage level is 12 volts while the voltage level of each device 80 is 11 volts. This ensures adequate isolation of the detonator firing element from unwanted signals in the sequential blasting system.

Figure 8:
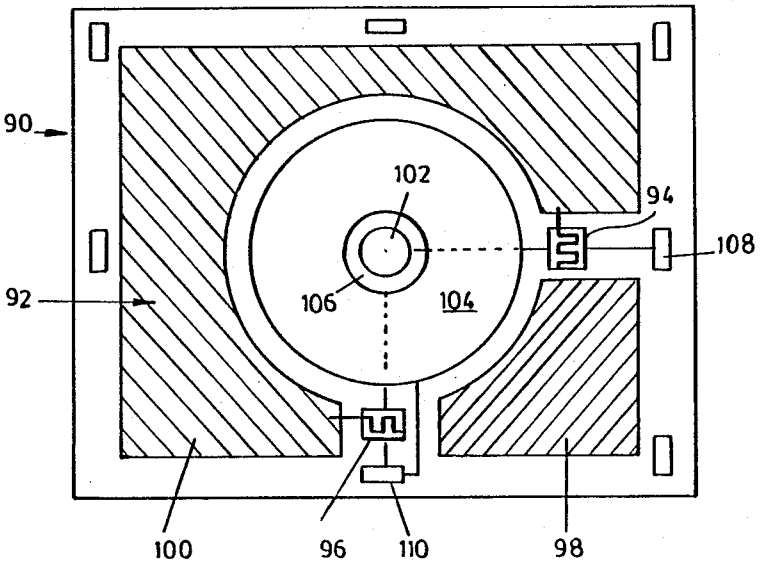
FIG. 8 is a plan view of a field effect detonator firing element incorporated in an integrated circuit in accordance with the invention.
Figure 9:
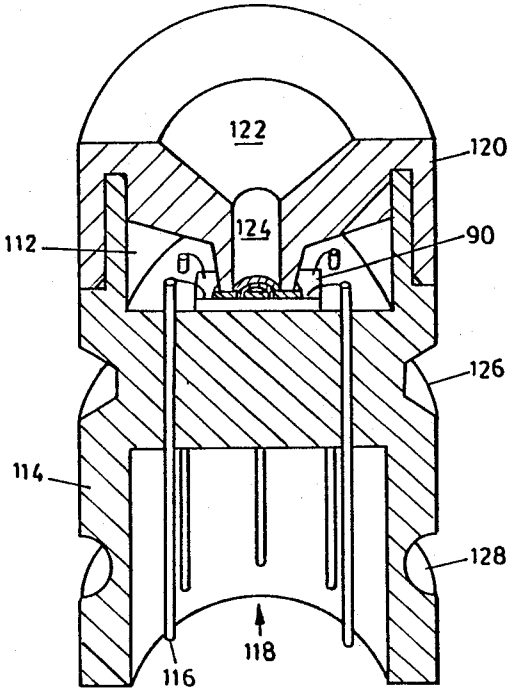
FIG. 9 depicts, from the side and in cross section, the physical arrangement of a detonator firing element.

FIGS. 8 and 9 show a detonator firing element which is based on a field effect structure.

FIG. 8 illustrates in plan an integrated circuit 90 which includes a detonator firing element generally designated 92, control transistors 94 and 96 respectively, overvoltage protection circuitry 98, and a timing and communication circuit 100.

The function of the circuits 98 and 100, and the manner of use of the detonator firing element including its incorporation in a sequential blasting system, may generally be effected in accordance with the preceding description.

The detonator firing element 92, in this example, includes a first, inner electrode 102 which is circular in outline and a second, outer electrode 104 which is located concentrically to the inner electrode, the two electrodes defining between them an annular gap 106. These shapes are by way of example only.

The transistors 94 and 96 are field effect devices. The transistor 94 has its drain connected to a positive pole 108 of an electrical supply and its source is connected to the electrode 102. Its gate is under the control of the circuit 100. The transistor 96 on the other hand has its source connected to a negative pole 110 of the electrical supply with its drain connected to the inner electrode 102. The gate of the device 96 is connected to the circuit 100. The outer electrode 104 is also connected to the pole 110.

The two electrodes 102 and 104 are formed by depositing one of the preferred materials on top of a passivation layer of the integrated circuit. The deposited metal is then etched to the desired shape.

FIG. 9 illustrates the mounting of the circuit 90 in a cavity 112 formed in a housing 114. Pins 116 project through a base of the cavity into a lower cavity 118. The pins are bonded to the circuit 90. In a manner analogous to that already described the pins are used respectively to supply power to the circuit, for data and clock information, reply information, data out and data in.

The cavity 118 contains a storage capacitor, not illustrated, which is connected to those of the pins 116 which define the poles 108 and 110 for supplying power to the detonator firing element 92.

An insert 120 is mounted on the housing 114. The insert includes a conical recess 122 the base of which terminates in a cylindrical passage 124 which extends onto and over the electrodes 102 and 104.

A primary explosive material such as silver azide, lead azide or lead styphnate is packed into the recess 122 and the passage 124. The insert 120 forms a cap and ensures that the explosive is confined in contact with the electrodes. The insert 120 is preferably made from an electrostatic conductive plastics material to reduce the risk of stray electric fields initiating the primary explosive material. The insert is in physical and electrical contact with the outer portion of the housing 114 which is electrically grounded by the appropriate pin 116.

The component shown in FIG. 9 is designed to be connected to a detonator can which is filled with a suitable explosive and which is fixed to the housing 114. The housing 114 is partly inserted into the mouth of the can with the primary explosive extending into the can and with the pins 116 projecting from the can. The can is then crimped into a groove 126 in the outer surface of the housing 114 to secure the components to one another. Another groove 128 is used to lock a wiring harness to the housing 114. The harness effects electrical connections to the various pins 116.

A plurality of the devices shown in FIG. 9 are incorporated, in the manner described, in a sequential blasting system in accordance with known techniques or in accordance with the procedure hereinbefore described. The storage capacitor in the cavity 118 is charged by means of a primary electrical source. The transistors 94 and 96 are under the control of the circuit 100. The circuits 98 and 100 are respectively controlled by data which is fed to the detonator along the "data in" line. Suitable firing delays can be programmed into the circuitry.

The detonator firing element is controlled as follows. Under normal conditions i.e. in an unarmed mode the transistor 94 is held off and the transistor 96 is turned on. The latter device, being on, keeps the electrodes 102 and 104 at the same potential. Thus there is no potential difference across the electrodes over the annular gap 106 or, otherwise put, the electrostatic field across this gap is zero.

If the transistor 94 is turned on and the transistor 96 is turned off then a potential difference is generated across the gap 106 which is equal to the supply voltage of the electrical source i.e. the voltage to which the storage capacitor in the cavity 118 is charged.

The electric field across the gap 106 initiates the sensitized primary explosive in the recess 122 and passage 124 and the blast for the particular detonator is therefore also initiated.

The strength of the field which is generated in this way can be controlled by varying the width of the gap 106 or by changing the applied voltage. To energise less sensitive explosives the applied potential across the gap may be increased through the use of a voltage multiplier. The transistor 94 may be fabricated with an "on-resistance" which is higher than that of the transistor 96. This ensures that the device 96 has to turn off and the device 94 has to turn on before the voltage across the gap 106 rises to its desired level i.e. the level at which initiation of the primary explosive material takes place. This safety feature ensures that both transistors have to be operated correctly for a blast to take place.

The approach described in connection with FIGS. 8 and 9 offers the advantage that deposition of specialised metals such as tungsten (W) or nichrome (NiCr) is obviated. The transistors 94 and 96 may also be made relatively small since they are not used for the switching of heavy currents but rather are used merely to control the application of voltage across the gap 106.

FIGS. 10 to 17 are concerned with further embodiments of the invention.

Figure 10:
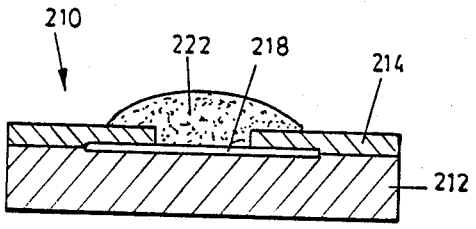
FIG. 10 is a sectional side view of a detonator firing element in accordance with another form of the invention.
Figure 11:
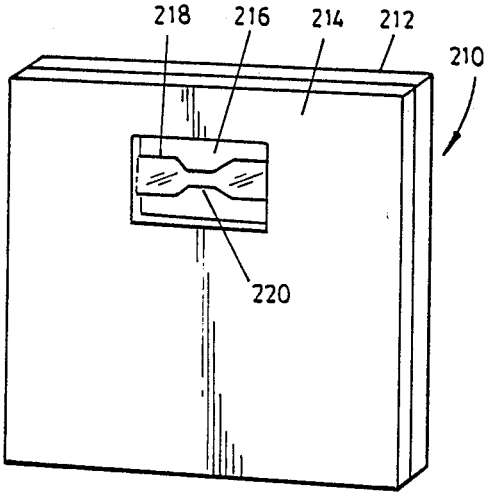
FIG. 11 is a perspective illustration of the detonator firing element of FIG. 10 before a primary explosive is adhered thereto, FIGS. 12A, 12B and 12C respectively are part sectional side views of three related embodiments of the detonator firing element of the invention.

FIGS. 10 and 11 show a detonator firing element 210 in the form of a silicon microchip which comprises a silicon substrate 212 covered by a thin layer 214 of a suitable passivation material such as a silicon dioxide. A window 216 is formed in the passivation layer 214 to expose an energy dissipation device in the form of an element or link 218 made from a preferred material. The link 218 is deposited on the substrate 212 by means of conventional deposition techniques and has a waisted portion 220 which is located substantially centrally in the window 216. A primary explosive material 222 is adhered to, or compressed against, the passivation layer 214, and covers the window 216 to be in contact with the link 218. The initiating charge 222 is not shown in FIG. 11 for the sake of clarity.

In certain applications the window 216 is not essential, and the charge 222 is mounted directly on the passivation layer in close proximity to the link 218, to be initiated by the link 218 either fusing or being heated to a sufficiently high temperature by the passage of electric current therethrough.

The charge 222 can be made of lead styphnate having a small percentage of binder or an adhesion promoter added thereto prior to its application to the substrate 212 to increase its adherence to the passivation layer 214.

The link 218 activates the charge 222 either by fusing or it may attain a sufficiently high temperature due to resistive heating to initiate the charge 222 while still remaining intact.

Figure 12A:
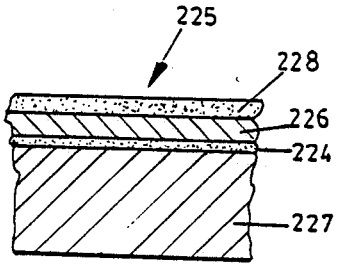
Figure 12B:
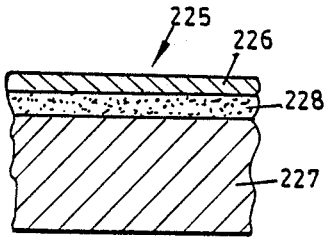

FIGS. 12A, 12B, and 12C show three further embodiments of a detonator firing element 225 which includes a silicon substrate 227 to which an activating means comprising a metal, or conductive, layer 226 and an exothermal or oxidising layer 228 in various configurations are adhered.

In FIG. 12A, a layer 224 of a dielectric material is adhered to, or grown on, the surface of the silicon substrate 227. A layer 226, of one of the preferred materials, is applied on top of the layer 224 of dielectric material. An exothermal or oxidising layer 228 is then applied on top of the layer 226. The layer 228 can be of a polyimide containing an oxidising compound such as potassium chlorate or a pyrotechnic medium which reacts with the layer 226.

In FIG. 12B, the exothermal or oxidising layer 228 is applied to the surface of the silicon substrate 212, and the layer 226 is applied on top of the layer 228.

In FIG. 12C, the layer 226 is sandwiched between two exothermal or oxidising layers 228.

Figure 12:
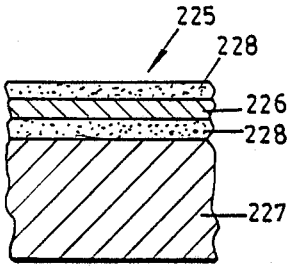

The embodiments of FIG. 12 rely for their operation on the fact that an exothermic reaction is initiated between the layer 226 and the exothermal or oxidising layer 228 immediately above and/or below the layer 226. The exothermic reaction is caused by the resistive heating of the layer 226 due to the passage of electric current therethrough. The primary explosive charge (not shown) is responsive to and is initiated by the exothermic reaction.

The oxidising layer 228 is deposited during the manufacturing process of the detonator firing element 210.

An advantage of these embodiments is that the deposition of the primary explosive need not rely on good contact being uniformly achieved over the active area of the detonator firing element 200. Accordingly production spreads can be tolerated during explosive deposition. Passivation of the detonator firing element 210 can also be effected to reduce lifetime variations. The materials used for the passivation may be polyimides or low deposition temperature or vacuum deposited oxides and nitrides.

Figure 13:
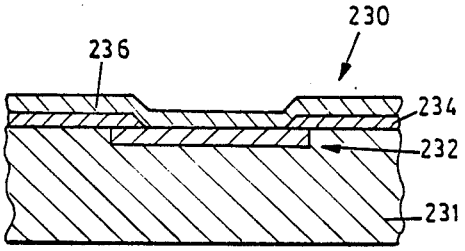
FIGS. 13 to 16 illustrate respectively other embodiments of the invention.

FIG. 13 shows a further embodiment of the invention wherein the detonator firing element 230 is in the form of a solid state electronic device having a silicon substrate 231.

An energy dissipation device 232 comprising a resistive portion of an electric circuit, is provided by means of a section of a diffused, an ion implanted, or an epitaxial element, formed in or on the silicon substrate 231. Metal links 234, applied to the surface of the silicon substrate 231 in electrical contact with the device 232, are connectable to a drive circuit (not shown). A passivation layer 236 is applied to or grown on top of the metal links 234 as well as the device 232.

The energy dissipation device 232 can be any circuit element such as a resistor, transistor or a four-layer diode. It is to be noted that if the device is a zener diode or some other type of active device, the energy generated thereby can be focussed accurately.

The energy dissipation device 232 can be formed by a layer of P-type silicon which is diffused into a predominantly N-type silicon substrate 231 to provide the resistive portion of the circuit. The layers of P-type silicon and N-type silicon can of course be interchanged. More energy can be dissipated in a diffused resistor before it ruptures than would be the case for a conventional metal link. This results in the advantage of having much more predictable initiation. In addition, it is easy to change the resistor doping to improve the electrical match to a near optimum level, and also the size can be readily adjusted. Further, this type of device is better suited to capacitor storage systems as all remaining energy in a capacitor can be dissipated into the resistor.

Figure 14:
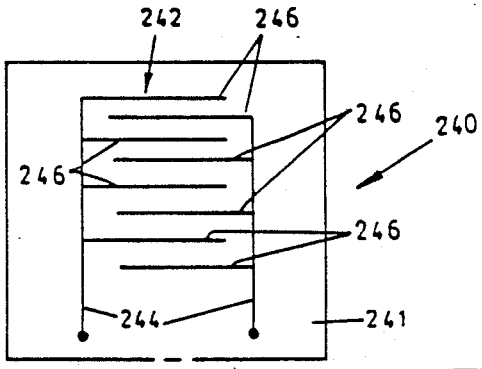

FIG. 14 shows a detonator firing element 240 which is a solid state electronic device having a silicon substrate 241. A layer of dielectrical material (not shown) can be applied to the silicon substrate 241. An electric field generating structure in the form of a comb or interdigitated structure 242 is applied to the silicon substrate 241, or it may be diffused therein. Clearly this is an alternative arrangement to that shown in FIGS. 8 and 9. A connection means 244 is provided for connecting the comb structure 242 to a drive circuit (not shown). The comb structure 242 comprises a plurality of spaced limbs 246. The spacing between adjacent limbs 246 is in the region of 10μm, or less.

The structure 242 enables a very high electric field to be maintained uniformly over an extended area. The initiating charge (not shown) is deposited directly on top of the structure 242. The initiating charge is mixed or associated with a finely-ground graphite or with an organic semi-conductor sensitizer as well as a binder. The direct contact between the initiating charge and the metal structure 242 causes the initiating charge to heat internally thereby causing initiating. Alternatively, the initiating charge may have a component, such as an organic semi-conductor suspending an oxidising agent, which reacts chemically in the presence of a suitably high electric field in an exothermic reaction. With this aspect of the invention, a device that can operate between a few volts and approximately 1kV and at limited current of the order of pico amperes can be realised.

Figure 15:
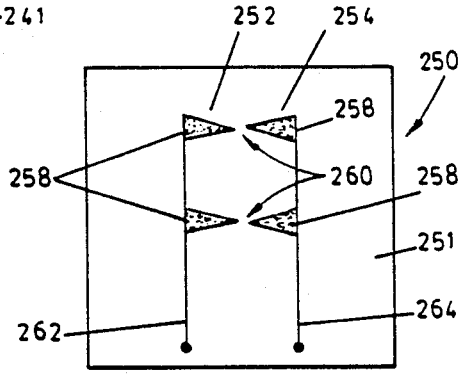

FIG. 15 shows a detonator firing element 25 which comprises a solid state electronic device having a silicon substrate 251 to which is applied, or in which is diffused, a discharge inducing structure. The discharge inducing structure comprises a pair of spaced tooth-like structures, 252 and 254. The structure 252 comprises a pair of spaced teeth 256. Likewise, the structures 254 comprises a pair of spaced teeth 258. The teeth 256 and 258 are aligned in spaced relationship with each other to provide a pair of discharge gaps 260. The structures 252 and 254 each have a connecting means 262 and 264, respectively, for connection to a drive circuit (not shown). The teeth 256 and 258 are used to concentrate an electric field in the gaps 260. At electric fields of greater than 5 V/μm discharge between the teeth 256 and 258 can take place. Once discharge commences, it will continue until the electrical energy is reduced, or until erosion of the teeth 256 and 258, or damage to the crystal lattice, has progressed sufficiently for the field to become too low to sustain the discharge.

A primary explosive (not shown) may be initiated directly by the discharge between the teeth 256 and 258, or indirectly by means of an exothermic chemical reaction with a layer which is in contact with the discharge inducing structure.

It is an advantage of this embodiment that a well-defined threshold voltage is achieved as a function of the spacing between the teeth 256 and 258 and that the threshold voltage may be varied between a few volts and about 1 kV.

Figure 16:
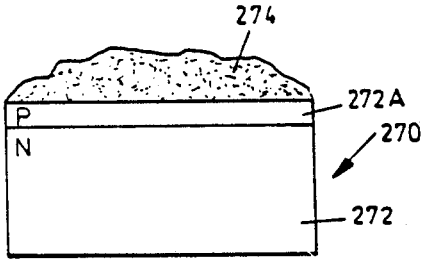

FIG. 16 shows a detonator firing element 270 which comprises a light-generating microchip 272 of N-type material with a layer 272A of P-type material to which a primary explosive 274 is applied. The explosive 274 is responsive to light generated by the microchip 272 which can be a compound semi-conductor laser or a light-emitting device or any other suitable light generating means, e.g. a conventional semi-conductor device producing light from plasma effects.

If the light generating microchip 272 is a laser, a sufficiently high energy density can be achieved to initiate the charge 274 directly. If the microchip 272 emits a lower-intensity illumination, an optically sensitised pyrotechnic compound can be used for the charge 274.

Figure 17:
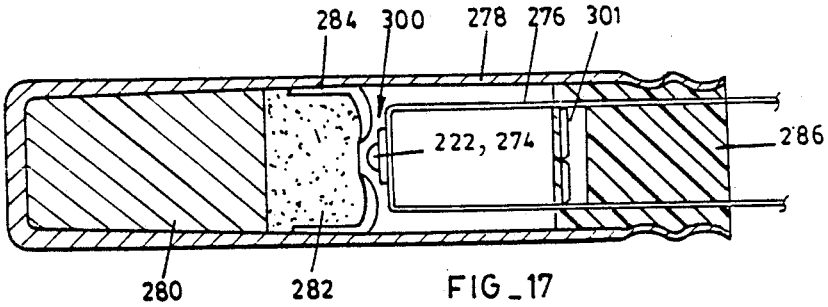
FIG. 17 is a sectional side view of a detonator containing a detonator firing element in accordance with a variation of the invention.

FIG. 17 shows a different packaging arrangement of a detonator firing element, to make up a detonator. The detonator firing element is mounted on a metal lead-frame 276 which in turn is mounted in a detonator capsule 278. A base charge 280 is provided within one end of the detonator capsule 278. The base charge 280 can be of an explosive material such as PETN. An ignition charge 282 of a suitable explosive material such as a 4:1 mixture of lead azide and lead styphnate is provided adjacent the base charge 280. The ignition charge 282 is located in close proximity to a primary explosive 222, 274 of any one of the detonator firing element hereinbefore described and designated 300. The ignition charge 282 is located in position by means of a locating cup 284.

The metal lead-frame 276 which carried the detonator firing element 300 passes through a suitable plug 286 which sealingly closes off an end of the capsule 278 opposite the end thereof within which the base charge 280 is provided. The plug 286 further serves to maintain the lead-frame in position. The lead-frame 276 provides electrical conductors for transmitting an electrical signal to the detonator firing element 300.

The detonator firing element 300 preferably embodies control circuitry (not shown), of the kind shown in FIGS. 3 and 6 to control the initiation of the primary explosive 222, 274, which is formed within the silicon substrate of the detonator firing element 300 using conventional micro-electronic techniques. A safety link 301, isolated from the initiating charge 222, 274, and shorting control wires of the lead-frame 276 are incorporated for reasons of safety.

Activation of the energy dissipation device, e.g. the zirconium link 218 illustrated in FIG. 10, causes a release of energy to activate the charge 222, 274 which thereupon ignites the ignition charge 282 which in turn ignites the base charge 280 which sets off the explosion intended to be initiated by the detonator.

It is apparent that the principles of the invention can be expressed in a variety of embodiments, each of which includes a miniaturised energy dissipation device formed in combination with an integrated circuit. This approach enables complex control functions to be carried out, with inherent reliability and fail-safe operation, at low cost.

The invention has been described with reference to a solid initiating explosive. As indicated the principles of the invention can be used in combination with a liquid or gaseous initiating explosive. The detonator firing element, for these examples, is preferably of the kind based on the use of a fusible link, or high voltage discharge. The fusible link, when fusing, scatters glowing fragments of the link into the liquid or gaseous initiating explosive, which ensures successful detonation. Highly successful initiation is also achieved with a high voltage discharge. During assembly the detonator firing element is sealed in a container such as the can 72 of FIG. 5 which also confines the liquid or gaseous initiating explosive. The problem of depositing explosive on the detonator firing element is thereby avoided.

The detonator of the invention, and the detonator firing element, can be used in conjunction with any explosive, whether for military, mining or other use.

We claim:

1. A detonator firing element which includes a suitable substrate for the fabrication of an integrated circuit, at least one energy dissipation device which is located a selected one of on and in said suitable substrate, an explosive adjacent the energy dissipation device which, upon being actuated, initiates the explosive by the dissipation of energy, and a passivation layer between at least a portion of the substrate and at least a portion of the explosive.

2. A detonator firing element according to claim 1, wherein the energy dissipation device is a selected one of a diffused resistor, an implanted resistor and a resistive element located a selected one of on a surface of the substrate and in the substrate, the resistive element being formed from at least one of the following: nichrome, tungsten, aluminium, zirconium, polysilicon and metal silicide.

3. A detonator firing element according to claim 1, wherein the energy dissipation device is a semi-conductor element which includes at least one of the following: a transistor, a field effect transistor, a four-layer device, a zener diode, and a light emitting device.

4. A detonator firing element according to claim 1, wherein the energy dissipation device is a field effect element which includes two spaced electrodes on the substrate, a voltage being applied across the electrodes in use thereby to generate a selected one of a high intensity electric field and a discharge between the electrodes.

5. A detonator firing element according to claim 4, which includes a field sensitizer.

6. A detonator firing element according to claim 1 in combination with a container, and wherein the explosive is a selected one of a liquid and a gas and is sealed in the container together with the detonator firing element.

7. A detonator firing element according to claim 1, wherein the explosive adheres at least to a selected one of a surface of the substrate and the passivation layer and use is made of an adhesion promoter to improve a bond between the explosive and the selected one of the substrate surface and the passivation layer.

8. A detonator firing element according to claim 1 wherein the substrate forms a solid state electronic device which includes integrated circuitry for controlling the actuation of the detonator firing element.

9. A detonator firing element according to claim 8 wherein the solid state electronic device includes overvoltage protection means connected to the energy dissipation device.

10. A detonator firing element according to claim 8 wherein the solid state electronic device includes switching means, connected to the energy dissipation device, to provide protection against induced electrical currents and precise control of initiation of the explosive.

11. A detonator firing element according to claim 8 wherein the energy dissipation device is formed integrally with the solid state electronic device.

12. A detonator which includes a housing, a detonator firing element mounted in the housing, and explosive material in the housing arranged to be initiated by said explosive;

said detonator firing element including a suitable substrate for the fabrication of an integrated circuit, at least one energy dissipation device which is located a selected one of on and in said substrate, said explosive being located adjacent the energy dissipation device which, upon being actuated, initiates the explosive by the dissipation of energy, and a passivation layer between at least a portion of the substrate and at least a portion of the explosive, said substrate forming a solid state electronic device which includes integrated circuitry for controlling the actuation of the detonator firing element.

13. A detonator according to claim 12 which includes energy storage means for applying electrical energy to the energy dissipation device and to the integrated circuitry.

14. A sequential blasting system which includes a plurality of detonators connected together, and means for controlling the firing of individual detonators;

each said detonator including a housing, a detonator firing element mounted in the housing, and explosive material in the housing arranged to be initiated by explosive within said detonator firing element;

said detonator firing element of each said detonator including a suitable substrate for the fabrication of an integrated circuit, at least one energy dissipation device which is located a selected one of on and in said substrate, explosive adjacent the energy dissipation device which, upon being actuated, initiates the explosive material by the dissipation of energy, and a passivation layer between at least a portion of the substrate and at least a portion of the explosive.

15. A sequential blasting system according to claim 14, wherein each respective detonator firing element includes communication means responsive to a signal from said firing control means for transmitting a signal on the status of said detonator firing element to said firing control means.

16. A sequential blasting system according to claim 15, wherein said plurality of detonators are serially connected together and which includes a terminating unit connected at one end of the serially connected detonators, said communication means of the respective detonator firing elements successively transmitting their respective status signals to said firing control means, and the terminating unit transmitting the signal to said firing control means to identify the end of the serially connected detonators.

* * * * *